US008468701B1

(12) United States Patent
Perez

(10) Patent No.: US 8,468,701 B1
(45) Date of Patent: Jun. 25, 2013

(54) FOLDING KNIFE ASSEMBLY

(76) Inventor: Michael Gregory Perez, Miami Springs, FL (US)

( * ) Notice: Subject to any disclaimer, the term of this patent is extended or adjusted under 35 U.S.C. 154(b) by 346 days.

(21) Appl. No.: 12/927,765

(22) Filed: Nov. 23, 2010

Related U.S. Application Data

(60) Provisional application No. 61/264,015, filed on Nov. 24, 2009, provisional application No. 61/293,629, filed on Jan. 9, 2010, provisional application No. 61/326,744, filed on Apr. 22, 2010, provisional application No. 61/332,768, filed on May 8, 2010, provisional application No. 61/333,316, filed on May 11, 2010, provisional application No. 61/333,578, filed on May 11, 2010, provisional application No. 61/334,614, filed on May 14, 2010, provisional application No. 61/380,279, filed on Sep. 6, 2010, provisional application No. 61/386,534, filed on Sep. 26, 2010, provisional application No. 61/388,412, filed on Sep. 30, 2010, provisional application No. 61/390,054, filed on Oct. 5, 2010.

(51) Int. Cl.
*B26B 1/04* (2006.01)

(52) U.S. Cl.
USPC ..... 30/161

(58) Field of Classification Search
USPC ..... 30/153, 155–161
See application file for complete search history.

(56) References Cited

U.S. PATENT DOCUMENTS 633,854 A * 9/1899 Kohn ..... 30/160
1,647,405 A 11/1927 Giesen
2,304,601 A * 12/1942 Schrade ..... 30/159
3,868,774 A 3/1975 Miori
4,120,088 A * 10/1978 Phelps ..... 30/160
4,719,700 A 1/1988 Taylor, Jr.
4,947,551 A * 8/1990 Deisch ..... 30/161
5,131,149 A 7/1992 Thompson et al.
5,331,741 A 7/1994 Taylor, Jr.
5,425,175 A * 6/1995 Rogers ..... 30/161
5,495,674 A 3/1996 Taylor, Jr.
5,661,908 A * 9/1997 Chen ..... 30/161
5,953,821 A * 9/1999 Mearns ..... 30/161
5,966,816 A * 10/1999 Roberson ..... 30/161
6,158,127 A 12/2000 Taylor
6,305,085 B1 * 10/2001 Stallegger et al. ..... 30/161
6,360,443 B1 3/2002 Remus
6,446,341 B1 * 9/2002 Wang et al. ..... 30/161
6,836,967 B1 * 1/2005 Sakai ..... 30/161
7,124,510 B2 * 10/2006 Frazer ..... 30/161
7,152,327 B2 * 12/2006 Rudisill et al. ..... 30/155
7,231,718 B2 * 6/2007 Outen ..... 30/161
7,249,417 B2 * 7/2007 Chu ..... 30/155
7,325,312 B1 2/2008 Janich
7,581,321 B2 * 9/2009 Kain ..... 30/153

(Continued)

*Primary Examiner* — Jason Daniel Prone
(74) *Attorney, Agent, or Firm* — Malloy & Malloy, P.L.

(57) ABSTRACT

A folding knife assembly includes a blade assembly which is disposable between an open configuration and a closed configuration. The blade assembly includes a fixed blade portion and a movable blade portion, wherein the fixed blade portion and moveable blade portion are cooperatively structured to engage one another in an interlocked configuration when the blade assembly is disposed in an open configuration. The folding knife assembly also includes a positioning assembly structured to facilitate disposition of the blade assembly between an open configuration and a closed configuration. A locking assembly is provided and is structured to operatively engage at least a portion of the positioning assembly to releasably secure the blade assembly in the open configuration, and to operatively disengage the positioning assembly to permit disposition of the blade assembly into a closed configuration.

5 Claims, 15 Drawing Sheets

U.S. PATENT DOCUMENTS

| | | | | |
|---|---|---|---|---|
| RE41,259 | E * | 4/2010 | McHenry et al. | 30/161 |
| 7,854,067 | B2 * | 12/2010 | Lake | 30/159 |
| 7,979,990 | B2 * | 7/2011 | Hawk et al. | 30/155 |
| 2005/0097755 | A1 * | 5/2005 | Galyean et al. | 30/161 |
| 2005/0262701 | A1 * | 12/2005 | Lai | 30/161 |
| 2006/0168817 | A1 * | 8/2006 | Kao | 30/153 |
| 2006/0272157 | A1 * | 12/2006 | Zeng | 30/161 |
| 2011/0010947 | A1 * | 1/2011 | Freeman | 30/159 |
| 2011/0067246 | A1 * | 3/2011 | Perez | 30/158 |
| 2012/0324738 | A1 * | 12/2012 | Chu et al. | 30/160 |

* cited by examiner

FOLDING KNIFE ASSEMBLY

CLAIM OF PRIORITY

The present application is based on and a claim of priority is made under 35 U.S.C. Section 119(e) to following previously filed and currently U.S. provisional patent applications: U.S. provisional patent application Ser. No. 61/264,015 having a filing date of Nov. 24, 2009; U.S. provisional patent application Ser. No. 61/293,629 having a filing date of Jan. 9, 2010; U.S. provisional patent application Ser. No. 61/326,744 having a filing date of Apr. 22, 2010; U.S. provisional patent application Ser. No. 61/332,768 having a filing date of May 8, 2010; U.S. provisional patent application Ser. No. 61/333,316 having a filing date of May 11, 2010; U.S. provisional patent application Ser. No. 61/333,578 having a filing date of May 11, 2010; U.S. provisional patent application Ser. No. 61/334,614 having a filing date of May 14, 2010; U.S. provisional patent application Ser. No. 61/380,279 having a filing date of Sep. 6, 2010; U.S. provisional patent application Ser. No. 61/386,534 having a filing date of Sep. 26, 2010; U.S. provisional patent application Ser. No. 61/388,412 having a filing date of Sep. 30, 2010; and, U.S. provisional patent application Ser. No. 61/390,054 having a filing date of Oct. 5, 2010, each of which are incorporated herein by reference in their entirety.

BACKGROUND OF THE INVENTION

1. Field of the Invention

The present application is directed to a folding knife assembly having a blade assembly comprising a fixed blade portion and a movable blade portion, wherein the fixed and moveable blade portions are structured and disposed to interlock with one another when the blade assembly is disposed in an open configuration.

2. Description of the Related Art

Knives are among the oldest and most common tools employed by modern mankind. As such, knives are available in a myriad of shapes, sizes, and designs for a wide variety of functions. As an example, the art related to knives range from large butcher knives for carving meat to tiny precision surgical knives, such as are employed in arthroscopic surgical procedures, with numerous variations in between. Further, given the usefulness of knives for a variety of purposes, folding knives have been developed over the years to make these tools safe for a user to carry on his or her person, yet remain readily available to be deployed when needed.

Typically, folding knives consist of a movable blade that is fixed to some type of pivot point within a handle, the handle being structured to shield the sharpened edge of the knife blade while it is in a closed position for a transport and/or storage. An important variation on the standard folding knife is a folding knife having a lock or stop such that a user must actuate some type of release mechanism in order to free the blade so that it may be moved from an open to a closed position. Some folding knives also incorporate a deployment mechanism, such as a spring assisted opening mechanism, commonly known as spring assisted opening knives or switch-blade knives, however, it is noted that such spring assisted opening mechanisms are illegal in many jurisdictions. A variation of such a spring assisted opening knife is a stiletto type knife, wherein the blade does not fold into the handle, but rather, is deployed lengthwise in and out of one an open end of a knife handle.

As with knives in general, folding knives have been developed for a wide variety of uses. For example, a miniaturize folding knife assembly commonly known as a pen knife are small enough to be carried on a keychain and are utilized for extremely light duty tasks such as cutting string, plastic, tape, etc. At the opposite end of the spectrum, folding knife assemblies employed substantially standard size knife blades made of hardened steel and being structured for heavy duty applications are often used by persons in the construction industry, sportsman, and other such rigorous activities wherein a heavy duty knife assembly is required. Typically, the user of such a large folding knife assembly will utilize a sheath or other holder in order to comfortably and safely carry the knife on his or her person, such as attached to a belt loop, tool belt, or other such article. Between these extremes, are a variety of intermediate sized folding knife assemblies commonly referred to as pocket knives. Once again, these pocket knives typically include a single movable blade which is attached to the handle via pivot member which allows the blade to be opened and closed. In addition, a good number of pocket knives employ some form of lock or stop in order to avoid possible injury to a user as a result of inadvertent closure of the blade while the knife is in use. A significant problem common to all of the folding knives noted above is a utilization of a single blade member which is only secured at one end by a pivot structure, which also serves to attach the blade member to the handle. More in particular, upon rotating the single blade from a closed to an opened position about its pivot point, only a small portion of the single blade member is retained within and supported by the knife handle. As a result, a substantial weak point exists in known folding knives when the blade is deployed in an open configuration, i.e., the weak point being the interface of the single blade member and the handle. In contrast, a fixed handle knife of similar dimensions will include a significant portion of a single fixed blade member, i.e., the tang or shank, being secured between opposing handle members. Thus, a single fixed blade knife assembly provides significantly greater strength and stability to the overall knife blade versus a folding knife assembly of similar dimension, i.e., useable blade length, and materials of construction of the blade, tang, handle, and connecting hardware.

As noted above, a number of folding knives include some form of lock or stop which is designed to retain the blade in an open or closed position until such time as the user actuates the release mechanism. It is also common for folding knives employing such a lock to require two handed operation by the user, more specifically, one hand to grasp the handle and actuate a release mechanism and the other hand to grasp and physically reposition the blade between open and closed positions. It is well known, however, that in many applications, it is not convenient or may not even be possible for a user to have both hands free in order to open and close a folding knife.

As such, it would be beneficial to provide a folding knife assembly which approaches the structural integrity of a single fixed blade knife of comparable dimensions in quality of materials. More in particular, it would be desirable to provide a folding knife assembly wherein a substantial portion of the blade assembly remains fixedly secured to at least a portion of the handle while another portion of the blade is deployed in an open configuration. It would also be helpful to provide such a folding knife assembly wherein deployment of at least the portion of the blade between open and closed configuration may be accomplished using only one hand. Yet another advantage may be realized by incorporating a self cleaning means into a folding knife assembly in order to prevent, or at least minimize the accumulation of dirt or debris from the inner workings of knife assembly so as to minimize maintenance and increase the useable life of the same. It would also be beneficial to provide such a folding knife assembly to comprise a minimal number of moving parts, once again, to minimize the need for maintenance and to assure a long useable life of such as folding knife assembly.

SUMMARY OF THE INVENTION

The present invention comprises a folding knife assembly. The folding knife assembly includes a handle which, in at least one embodiment, comprises a fixed member and a positionable member. The folding knife assembly of the present invention further comprises a blade assembly having a fixed blade portion and a movable blade portion. The blade assembly is disposable between an open configuration and a closed configuration, as described in further detail hereinafter. In at least one embodiment, the handle is structured to substantially overlie the blade assembly while the blade assembly is disposed in the closed configuration.

In each embodiment of the present invention, the fixed blade portion comprises a fixed interlock and the movable blade portion comprising a movable interlock, wherein the movable interlock is structured and disposed to releasably engage the fixed interlock in an interlocked orientation when the blade assembly is disposed in an open configuration. More in particular, the blade assembly may initially comprise a single unitary construction, and the moveable blade portion may be separated from the fixed blade portion by any of a number of techniques including, but not limited to, wire electrical discharge machining, laser cutting, die cutting, or pressing, such that the movable blade portion and the fixed blade portion may be realigned with one another along their cooperatively structured interface.

The folding knife assembly of the present invention also includes a positioning assembly structured to permit disposition of the blade assembly between the open configuration and the closed configuration. In at least one embodiment, the positioning assembly includes at least one positioning pin, and in one further embodiment, the positioning pin is structured and disposed to securely yet movable engage the movable blade portion, thereby permitting the movable blade portion of the blade assembly to be positioned into and out of the open configuration.

The at least one positioning pin comprises a positioning channel which is cooperatively structured with an engagement member of a lock mechanism to allow the blade assembly to be secured in the open configuration while in use. More in particular, the folding knife assembly of the present invention includes a locking assembly structured to operatively engage the positioning assembly and releasably secure the blade assembly in the open configuration.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 9 is a perspective cross-sectional view of the positioning pin of FIG. 8 along lines 9-9 thereof.

FIG. 10 is a perspective cross-sectional view of the positioning pin of FIG. 8 along lines 10-10 thereof.

Like reference numerals refer to like parts throughout the several views of the drawings.

DETAILED DESCRIPTION OF THE PREFERRED EMBODIMENT

Figure 2:
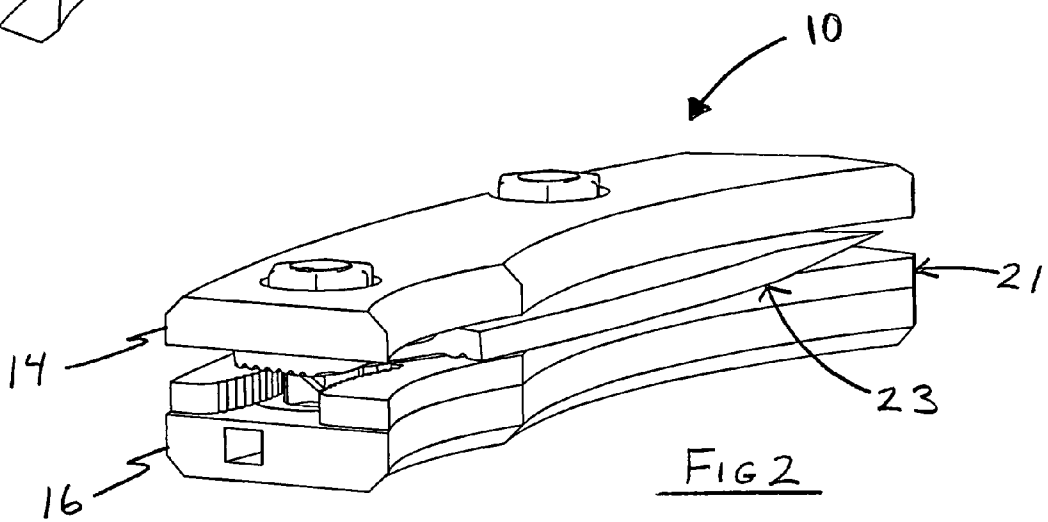
FIG. 2 is a perspective view of the illustrative embodiment of FIG. 1 disposed in a closed configuration.
Figures 18, 19, 20:
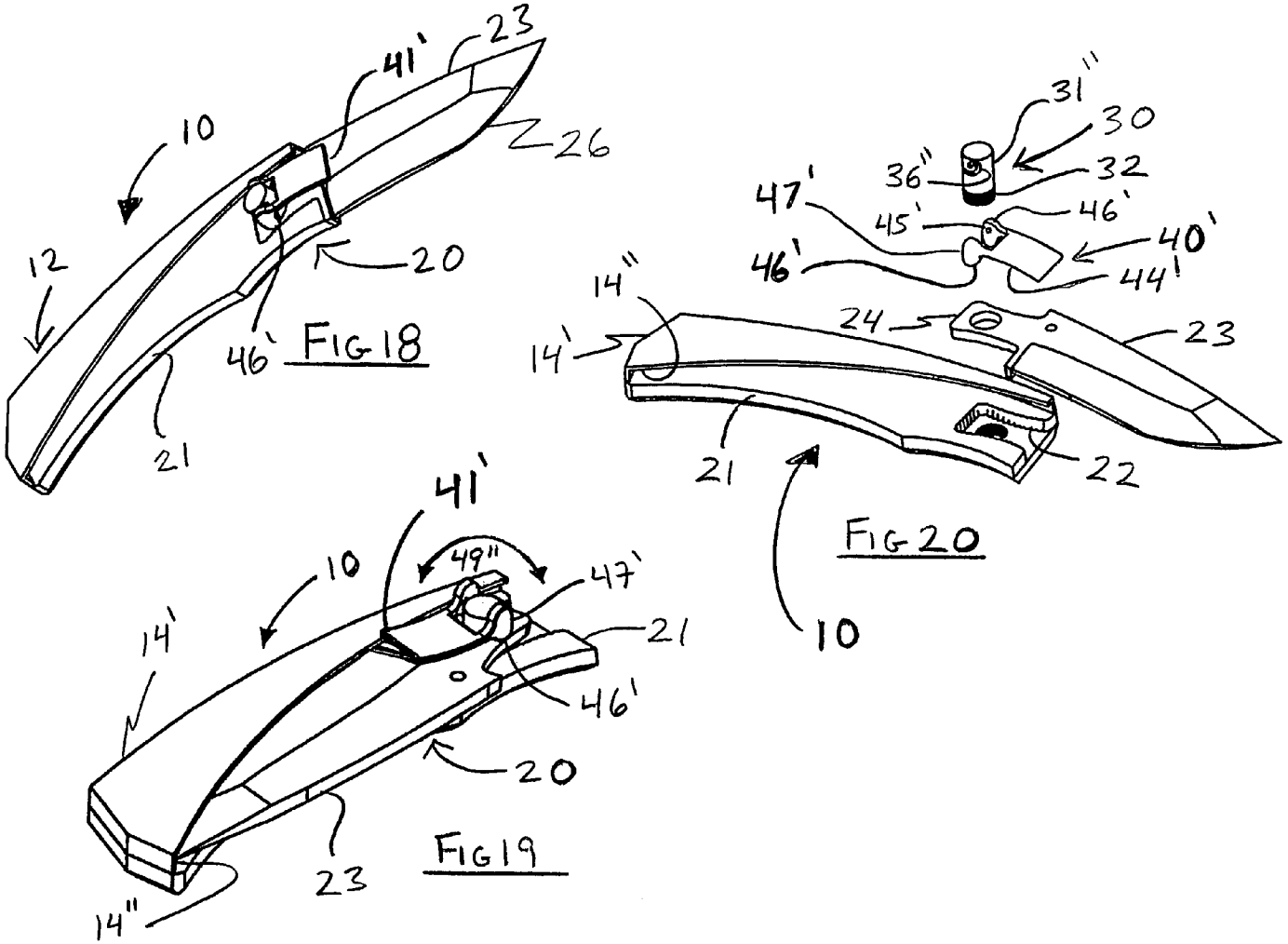
FIG. 18 is a perspective view illustrative of another embodiment of a folding knife assembly in accordance with the present invention, disposed in an open configuration.
FIG. 19 is a perspective view of the illustrative embodiment of FIG. 18, disposed in a closed configuration.
FIG. 20 is an exploded perspective view of the illustrative embodiment of the folding knife assembly of FIG. 18.

The present application is directed to a folding knife assembly generally as shown as 10 throughout the figures. More in particular, the present folding knife assembly 10, in at least one embodiment, includes a handle 12 having a fixed handle member 14 and a positionable handle member 16 which are cooperatively structured to substantially overlie a blade assembly 20, while the blade assembly 20 is disposed in a closed configuration, such as is illustrated in FIG. 2. In at least one alternate embodiment, such as illustrated in FIGS. 18 through 20, the handle 12 of the folding knife assembly 10 has a unitary construction comprised of a single, unitary fixed handle member 14', wherein the unitary fixed handle member 14' comprises a retention channel 14" structured to overlie at least the cutting edge 26 of the blade assembly 20, while disposed in a closed configuration as illustrated in FIG. 19. It will be appreciated that any of a number of materials of construction may be selected that will be suitable for a handle 12, or portions thereof, in accordance with the present invention. A few examples include, but in no manner are limited to, a G-10 fiberglass resin laminate, such as MICARTA® manufactured by Norplex-Micarta Industrial Composites, NYLON®, or other synthetic materials exhibiting similar strength, handling, and manufacturability characteristics. It is well within the scope and intent of the present invention to incorporate one or more additional or alternative materials of construction into a handle 12 or portions thereof.

As noted above, the handle 12 of the present folding knife assembly 10 is structured to house a blade assembly 20. The blade assembly 20, common to each embodiment of the folding knife assembly 10 in accordance with the present invention, comprises a fixed blade portion 21 and a moveable blade portion 23, as best illustrated in FIGS. 3 through 6. As illustrated in the figures, the fixed blade portion 21 includes a fixed interlock 22 which comprises a cut-out of one end of the fixed blade portion 21. In at least one embodiment, the fixed interlock 22 comprises an hourglass configuration, as best illustrated in FIG. 5. As noted above, the blade assembly 20 further comprises a movable blade portion 23, wherein the movable blade portion 23 comprises a movable interlock 24.

Figure 3:
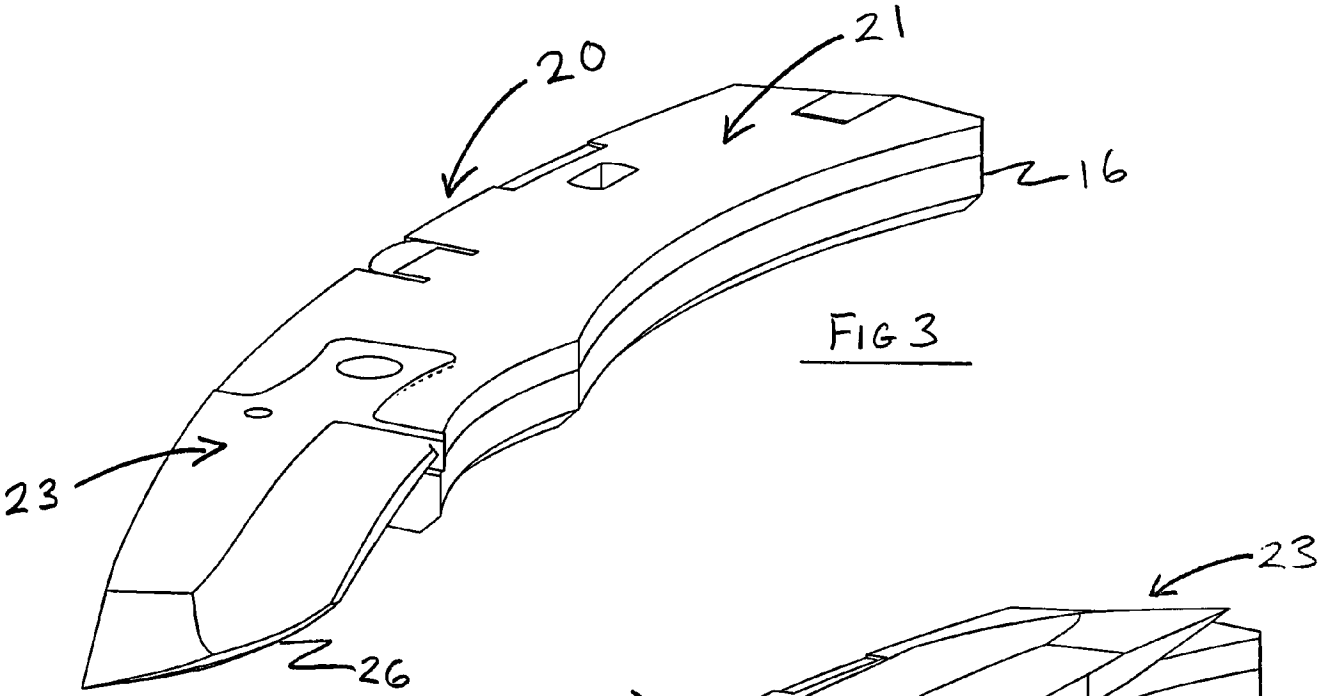
FIG. 3 is a partial cutaway view of the illustrative embodiment of FIG. 1 disposed in an open configuration.

Looking to FIG. 3, which is a partial cut-away view illustrative of one embodiment of a folding knife assembly 10 in accordance with the present invention, a movable interlock 24 of movable blade portion 23 is disposed in an interlocked orientation with a fixed interlock 22 of fixed blade portion 21. As demonstrated in FIG. 3, while the blade assembly 20 is disposed in an open configuration, the fixed blade portion 21 and the movable blade portion 23 are disposed in an interlocked orientation with one another so as to create quasi-single blade element, part of which remains closed within the handle 12, i.e., the fixed blade portion 21, and part of which remains exposed in an open configuration from the handle 12, i.e., the movable blade portion 23, to permit use of the same. Looking again to FIG. 3, while disposed in an open configuration, fixed blade portion 21 and movable blade portion 23 are disposed in substantially planar arrangement relative to one another. More in particular, this planar arrangement results in combining the fixed blade portion 21 and the movable blade portion 23 of the blade assembly 20 to form a quasi-single blade element which will exhibit improved strength and handling characteristics comparable to those of a single blade knife having part of the blade; i.e., the blade tang, fixedly secured in a handle member.

It is within the scope and intent of the present invention to initially forge a blade assembly 20 as a single unitary blade, and then separate the single unitary blade into its separate components, i.e., fixed blade portion 21 and moveable blade portion 23, by any of a number of techniques including, but not limited to, wire electrical discharge machining, laser cutting, die cutting, or pressing the single unitary blade to form fixed interconnect 22 and corresponding moveable interconnect 24 thereon, respectively. This procedure will not only simplify the manufacturing process, but will insure structural compatibility of the fixed blade portion 21 and the movable blade portion 23 of each blade assembly 20, in accordance with the present invention.

Figure 4:
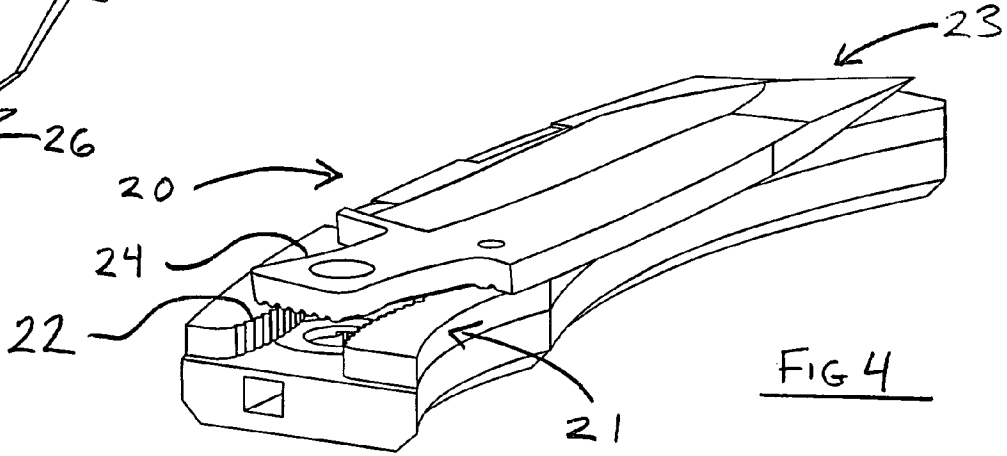
FIG. 4 is a partial cutaway view of the illustrative embodiment of FIG. 2 disposed in a closed open configuration.
Figure 5:
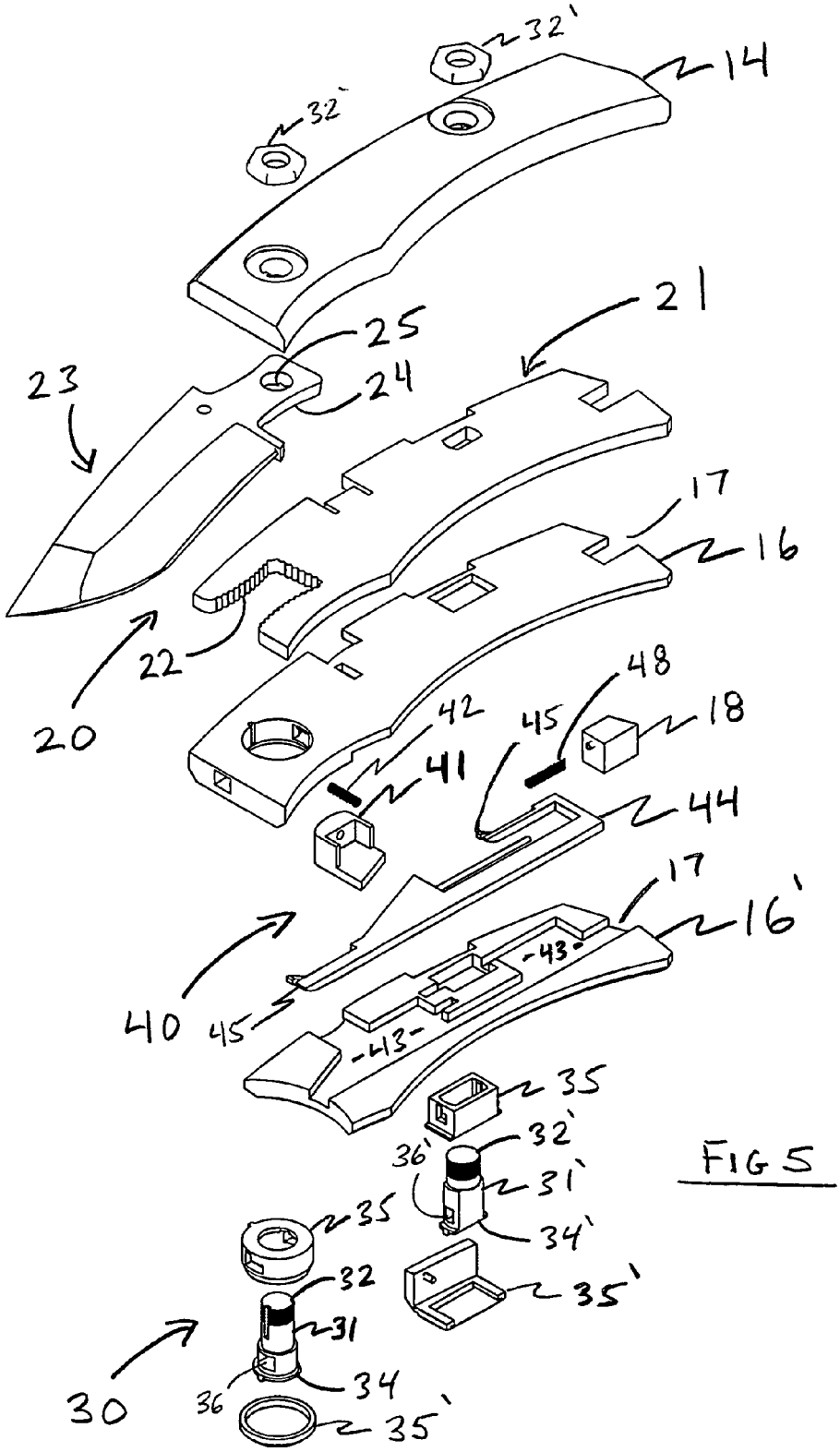
FIG. 5 is an exploded view of the illustrative embodiment of the folding knife assembly of FIG. 1.
Figure 6:
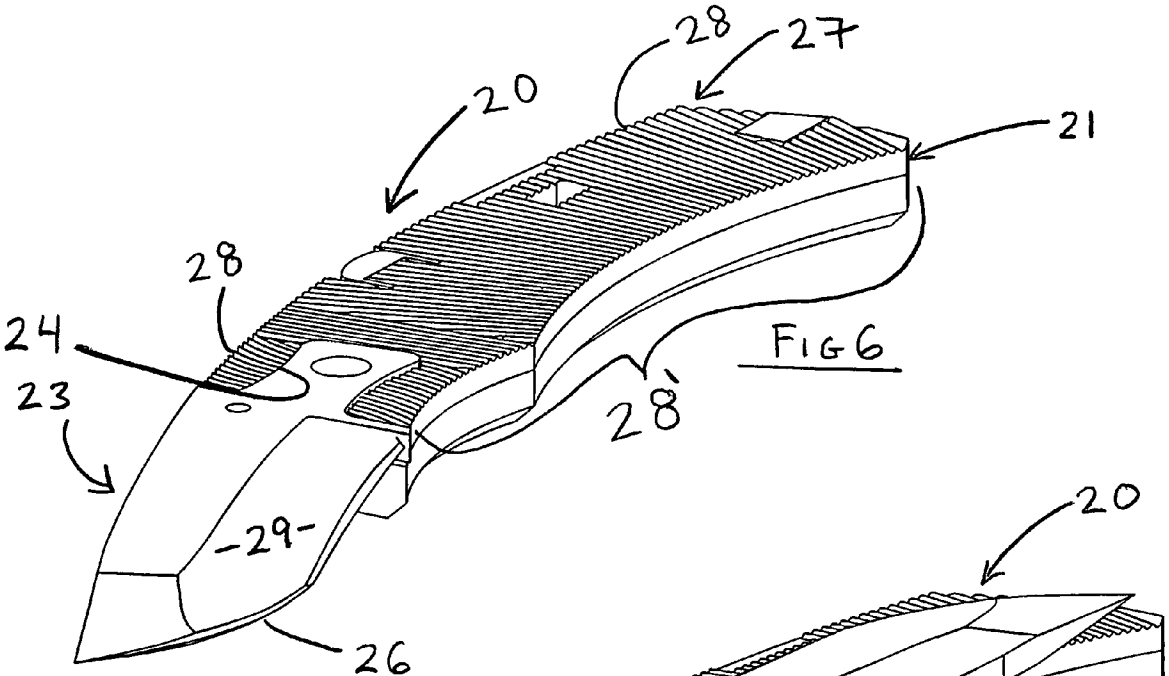
FIG. 6 is a partial cutaway view of another embodiment of a folding knife assembly in accordance with the present invention disposed in an open configuration and illustrating a plurality of debris channels disposed in a predetermined array.
Figure 7:
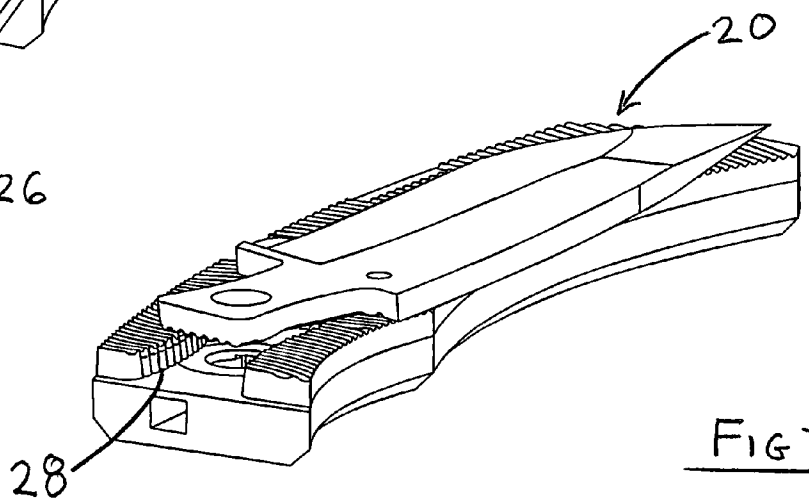
FIG. 7 is a partial cutaway view of the embodiment of FIG. 6 disposed in a closed configuration.

FIG. 4 is illustrative of one embodiment of a blade assembly 20 in a closed configuration, wherein the fixed blade portion 21 and the movable blade portion 23 are disposed in a substantially overlying arrangement with one another. It is noteworthy from FIG. 4 that the fixed blade portion 21 and movable blade portion 23 are no longer disposed in a substantially planar arrangement with one another while the blade assembly 20 is disposed in a closed configuration.

As illustrated in the embodiments of FIGS. 2 and 4, the moveable blade portion 23 is configured such that the cutting edge 26 is substantially concealed by the handle 12 when the blade assembly 20 is disposed in a closed configuration. However, in at least one embodiment, the movable blade portion 23 may comprise an extended length such that at least a section of the cutting edge 26 of the movable blade portion 23 remains exposed and useable even while the blade assembly 20 is disposed in the closed configuration. Of course, in such an embodiment, a sheath or other appropriate storage means may be employed to permit safe transport and storage of the folding knife assembly 10.

In at least one embodiment, the blade assembly 20 comprises a self cleaning means 27 in order to minimize and/or prevent dirt and debris from accumulating which may impede movement of the blade assembly 20 between open and closed configurations. The self cleaning means 27 may comprise a coating 29 on the surface of the movable blade portion 23 and/or along the surface of fixed blade portion 21, to reduce friction on the corresponding surface or surfaces. In at least one embodiment, the movable blade portion 23 and/or the fixed blade portion 21 may be polished to a Grade A mirror finish or Grade B mirror finish.

When a coating 29 is employed, it will comprise substantial friction reduction properties so as to prevent the accumulation or adherence of dirt and/or debris to either movable blade portion 23 or fixed blade portion 21, which could impede the opening and closing of the folding knife assembly 10. The coating 29 selected must be compatible with the material of construction of the blade assembly 20 itself, which may comprise 440C stainless steel, S7 tool steel, A2 tool steel, or other such materials exhibiting similar strength and hardness properties. In addition, the coating 29 must have sufficient inherent structural integrity to withstand the rigorous operating condition to which a knife blade may be subjected, such as is exhibited by various high wear diamond-like coatings. Examples of suitable coatings 29 include, but are not limited to, high wear coatings such as aluminum titanium nitride or aluminum chromium nitride. The coating 29 may be applied by a number of known processes, such as physical vapor deposition.

In at least one other embodiment, the self cleaning means 27 comprises a plurality of debris channels 28 on the surface of fixed blade portion 21 and/or fixed interlock 22. In at least one embodiment, the debris channels 28 comprise a predetermined geometry structured to facilitate the transport of dirt and debris therethrough. As shown in the illustrative embodiment of FIG. 6, the plurality of debris channels 28 may also be disposed in a predetermined array 28'. More in particular, the plurality of debris channels 28 are structured and disposed in the predetermined array 28' so as to provide clearance between the movable blade portion 23 and the fixed blade portion 21 and/or fixed interconnect 22 to provide a pathway for dirt or debris which may adhere to the moveable blade portion 23 to be displaced and exit the interior of the folding knife assembly 10 of the present invention. As such, the plurality of debris channels 28 are structured and disposed so as to prevent, or at least minimize, impeding the operation of the folding knife assembly 10, specifically, preventing dirt and/or debris from impending the positioning of the moveable blade portion 23 between open and closed configurations. In at least one embodiment, fixed handle member 14 may also comprise a plurality of debris channels 28 disposed in a predetermined array 28', so as to provide further clearance for dirt and debris which may adhere to movable blade portion 23.

In at least one further embodiment, handle 12 comprises an access port 17 to permit a user access to the interior of the folding knife assembly 10 to allow for cleaning and/or unjamming of the lock mechanism 44 described below. An access plug 18 is provided prevent dirt or debris from entering the interior of the folding knife assembly 10 via the access port 17, while the assembly 10 in is use, transport, or storage.

Figure 1:
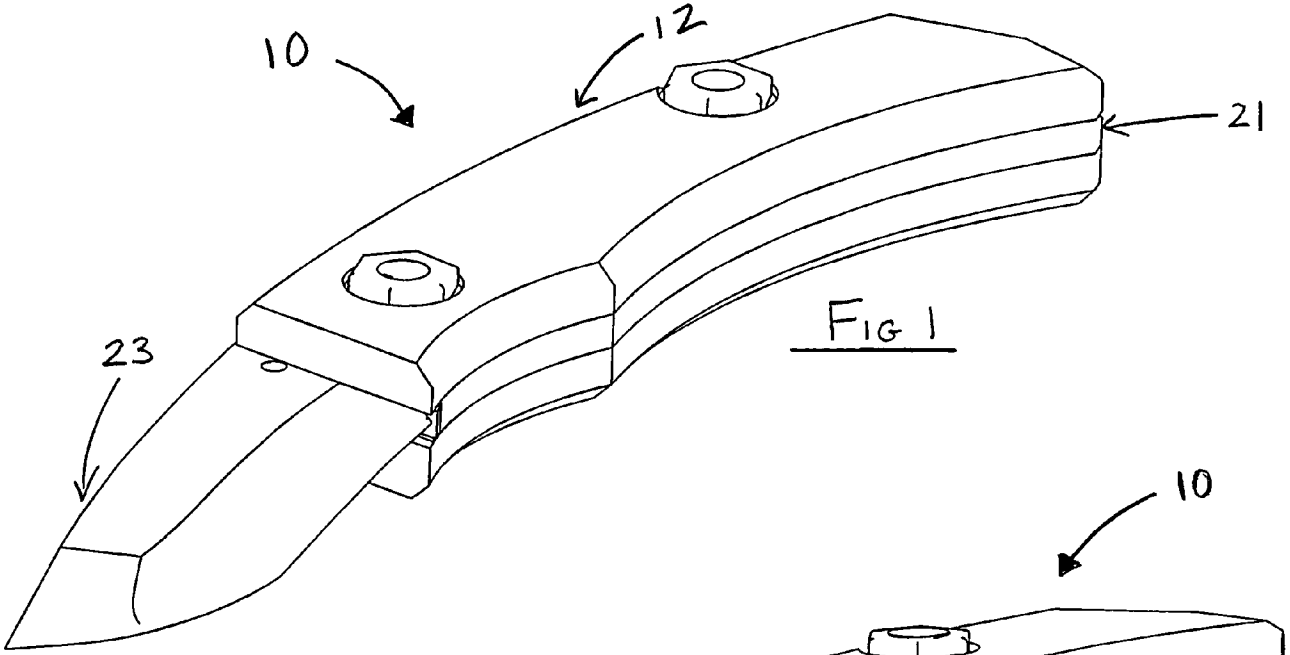
FIG. 1 is a perspective view of one illustrative embodiment of a folding knife assembly in accordance with the present invention disposed in an open configuration.

The folding knife assembly 10 in accordance with the present disclosure further includes a positioning assembly such as is shown at 30 throughout the figures. The positioning assembly 30 is structured to facilitate disposition of the blade assembly 20 between the open configuration, as illustrated in FIGS. 1 and 18, and the closed configuration, illustrated in FIGS. 2 and 19. Additionally, in at least one embodiment, the positioning assembly 30 is structured to facilitate positioning parts of the handle 12, and more in particular, fixed handle member 14 and positionable handle member 16, relative to one another, and as a result, relative to the blade assembly 20.

In accordance with the present invention, the positioning assembly 30 comprises at least one positioning pin 31 which is mounted to a portion of the handle 12 of the folding knife assembly 10. Further, at least one positioning pin 31 is structured to engage at least part of the movable blade portion 23 in such a manner that the movable blade portion 23 remains movable relative to the positioning pin 31.

In the illustrative embodiments of FIGS. 1 and 5, the positioning assembly 30 includes at least one positioning pin 31 structured to engage a part of movable blade portion 23, wherein the at least one positioning pin 31 has a fixed end 32 which is mounted to at least a portion of the handle 12 as illustrated in FIGS. 1 and 5. More in particular, as may be seen from FIG. 5, the fixed end 32 of positioning pin 31 is mounted to fixed handle member 14 via fastener 32'. The fixed end 32 and fastener 32', as illustrated herein, comprise cooperatively structured threaded interconnections, however, it is well within the scope and intent of the present invention for other mechanical fastening means to be employed to securely attach a fixed end 32 of a positioning pin 31 to a portion of a handle 12 in accordance with the present invention including, but not limited to, riveting, welding, adhesives, etc. In the alternate embodiment of a folding knife assembly 10 illustrated in FIGS. 18 through 20, at least one positioning pin 31 is mounted to a portion of the unitary fixed handle member 14', and is structured to engage a part of movable blade portion 23, as will described in greater detail below.

Figure 16A:
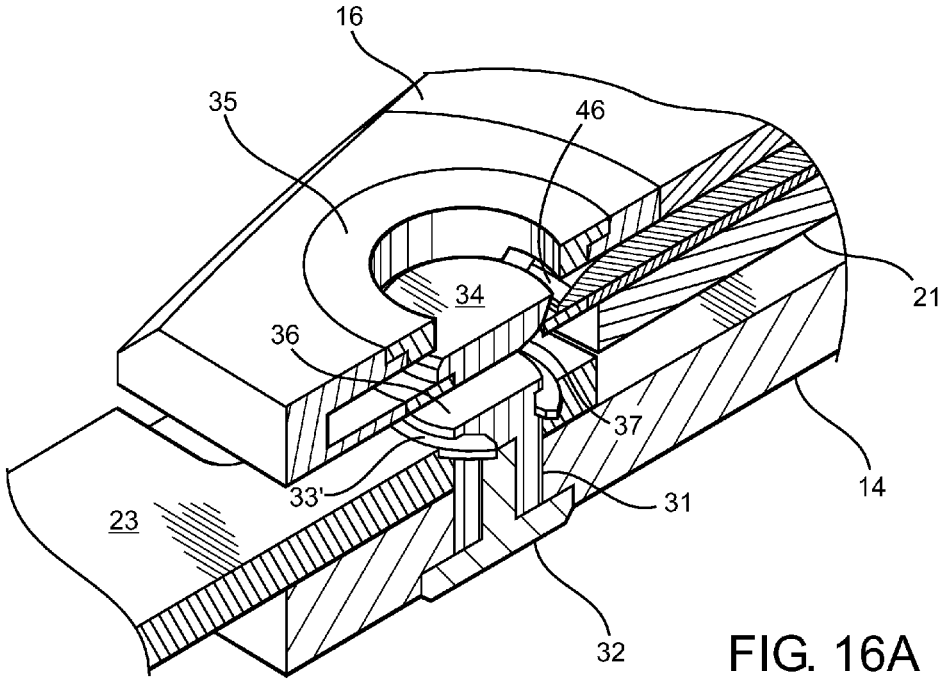
FIGS. 16A through 16C are partial cross-sectional perspective views of one embodiment of an engagement member relative to a positioning pin disposed in an unlocked, partially locked, and locked orientation, respectively, in accordance with the present invention.
Figure 17A:
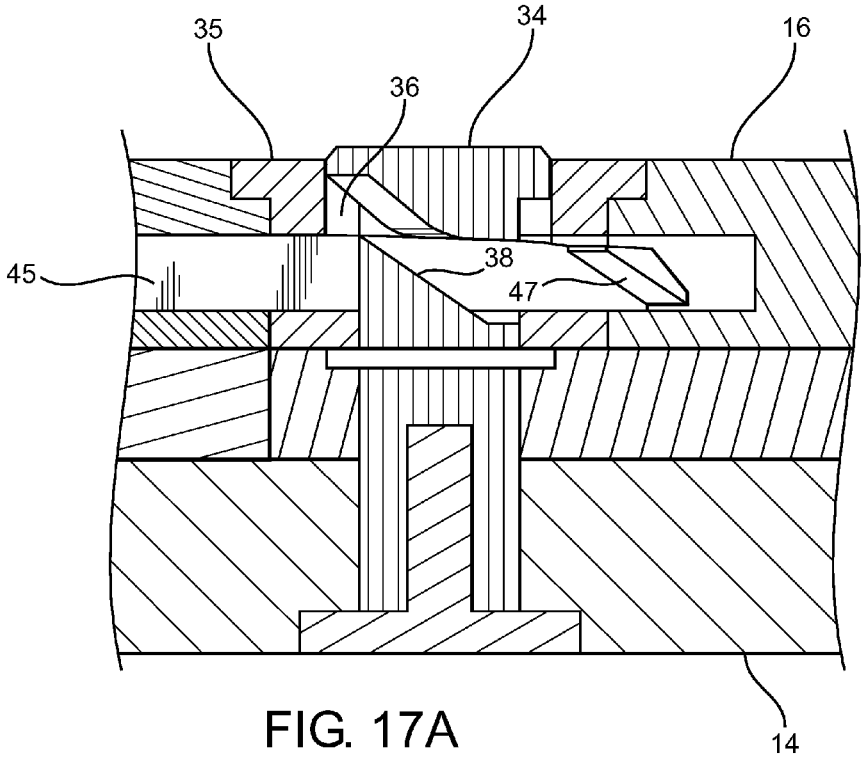
FIGS. 17A through 17C are partial cross-sectional views of one embodiment an engagement member relative to a positioning pin disposed in a locked, partially unlocked, and unlocked orientation, respectively, in accordance with the present invention.
Figure 17B:
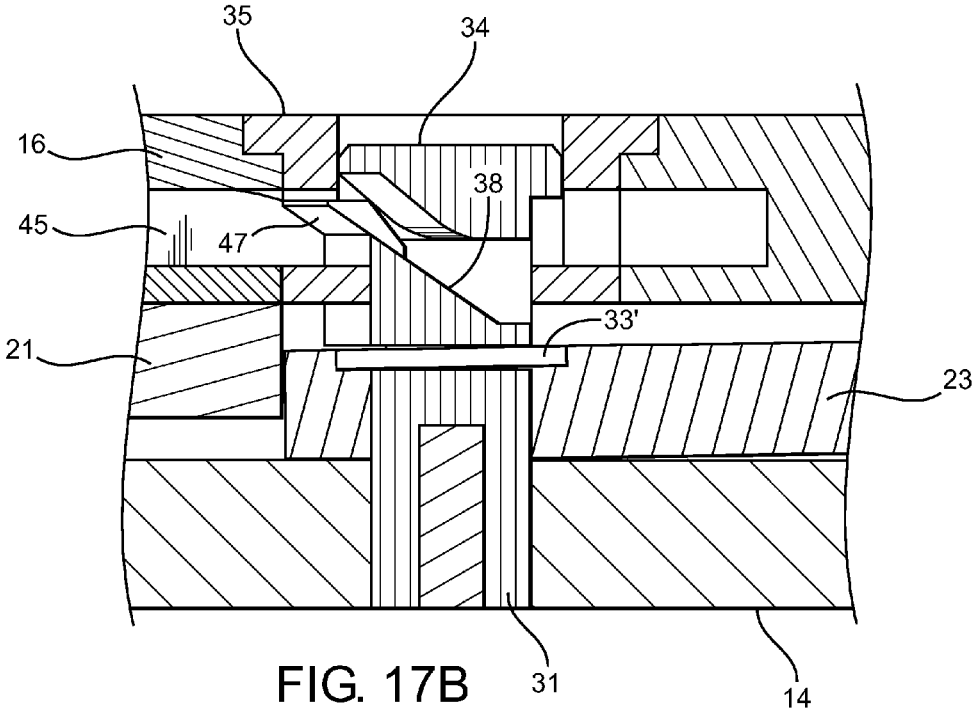
Figure 17C:
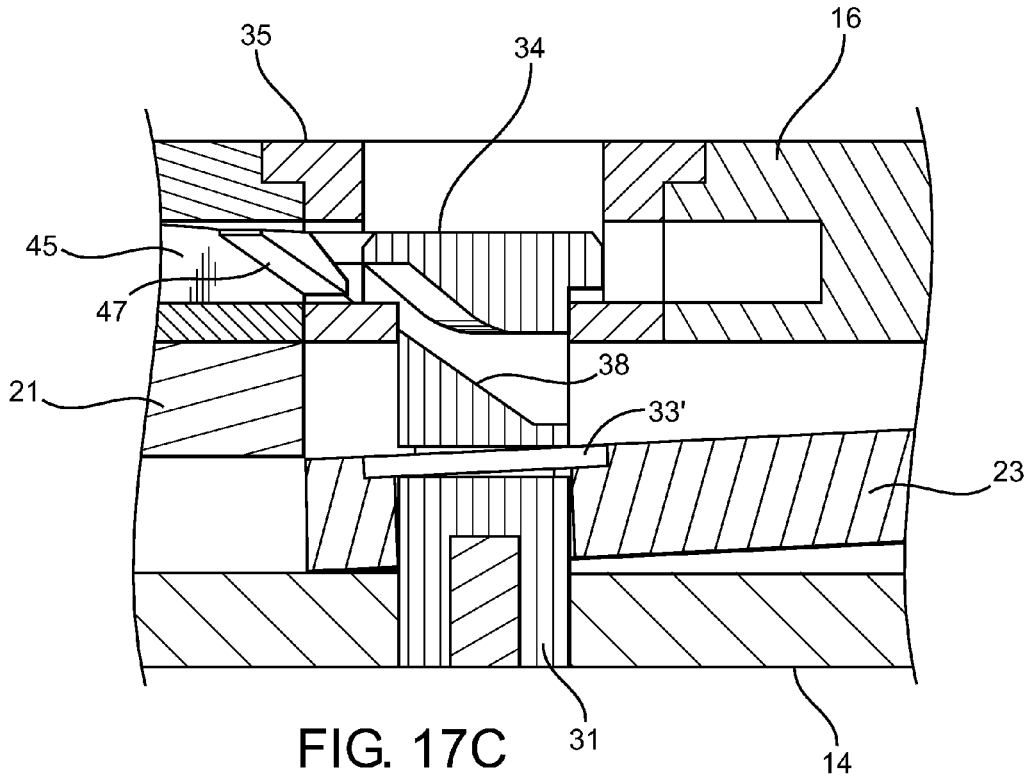

In at least one embodiment, and as illustrated best in FIG. 5, movable blade portion 23 comprises a pivot aperture 25 disposed through a portion of movable interlock 24. The pivot aperture 25 of movable blade portion 23 is structured to engage a positioning pin 31 in a manner that allows the movable blade portion 32 to be positionable about and relative to positioning pin 31. In at least one embodiment, positioning pin 31 comprises a blade retaining mechanism 33, wherein the blade retaining mechanism 33 is structured and disposed to moveably secure the movable blade portion 23 to at least a portion of the positioning pin 31. In at least one embodiment, the blade retaining mechanism 33 comprises a step or ledge formed in the shaft of the positioning pin 31 itself, as illustrated best in FIGS. 8 through 10. In one further embodiment, the blade retaining mechanism 33 comprises a blade retainer 33' structured to moveably secure the moveable blade portion 23 immediately adjacent fixed handle member 14 about the shaft of positioning pin 31, as best illustrated in FIGS. 16A and 17C.

Looking again to the illustrative embodiment of FIG. 5, the positioning assembly 30 may comprise a plurality of positioning pins 31, 31' structured to facilitate the relative positioning of parts of the handle 12 and the blade assembly 20 relative to one another. In the illustrative embodiment of the present invention wherein the positioning assembly 30 comprises a plurality of positioning pins 31, 31', the moveable blade portion 23 is structured to operatively engage only one of the plurality of positioning pins 31, such as via pivot aperture 25 as described above. In an embodiment of the present invention comprising a plurality of positioning pins 31, 31', at least one of the positioning pins 31 is primarily structured to facilitate movement of the fixed handle member 12 and the positionable handle member 16 toward and apart from one another during operation of a locking assembly 40, as is discussed in further detail below.

Figure 8:
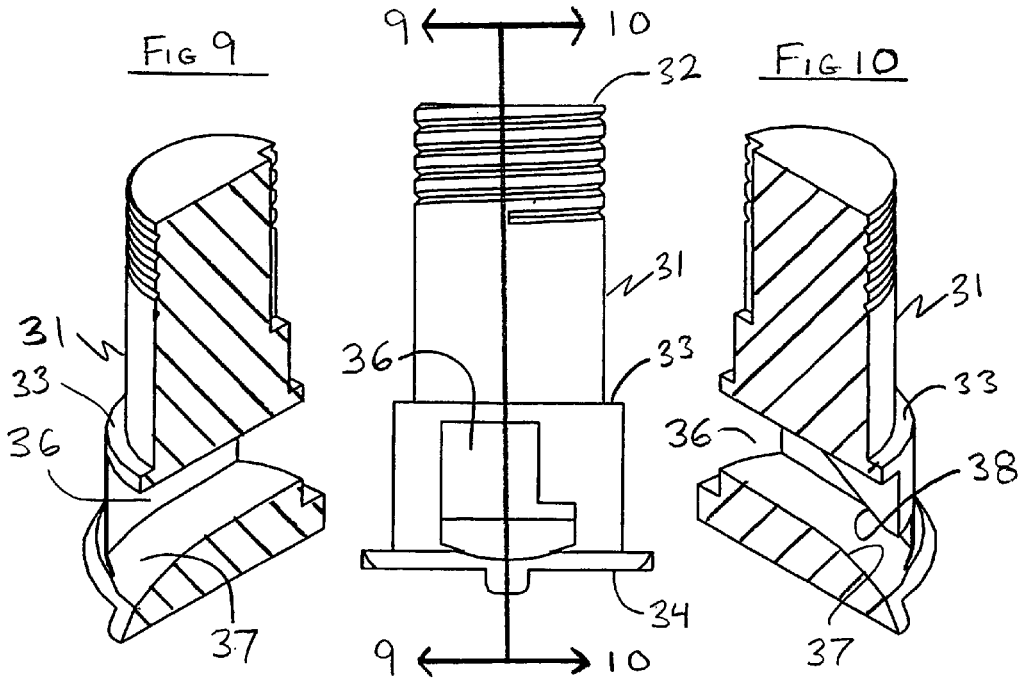
FIG. 8 is an elevation of one illustrative embodiment of a positioning pin in accordance with the present invention.

FIGS. 8 through 10 are representative of at least one embodiment of a positioning pin 31 in accordance with the present invention. As noted above, in at least one embodiment, positioning pin 31 includes a fixed end 32 and a free end 34. As illustrated in FIGS. 8 through 10, fixed end 32 of positioning pin 31 is threaded to facilitate secure attachment of the fixed end 32 to a part of the handle 12, and in at least one embodiment, to the fixed handle member 14. FIG. 8 is also illustrative of at least one embodiment of a positioning channel 36 formed through at least a portion of the positioning pin 31. As will be described in further detail below, positioning channel 36 is structured to receive at least a portion of an engagement member 45 of a lock mechanism 44 therein.

More in particular, looking to FIG. 9, the positioning channel 36 comprises a closing surface 37 which is configured to correspond to a closing element 46 of an engagement member 45, as will be described in greater detail below with reference to FIGS. 16A through 16C. In at least one embodiment, closing surface 37 is configured to slope in an upwardly direction from the mouth of the positioning channel 36, as shown in FIG. 8, into the interior thereof.

Figure 8A:
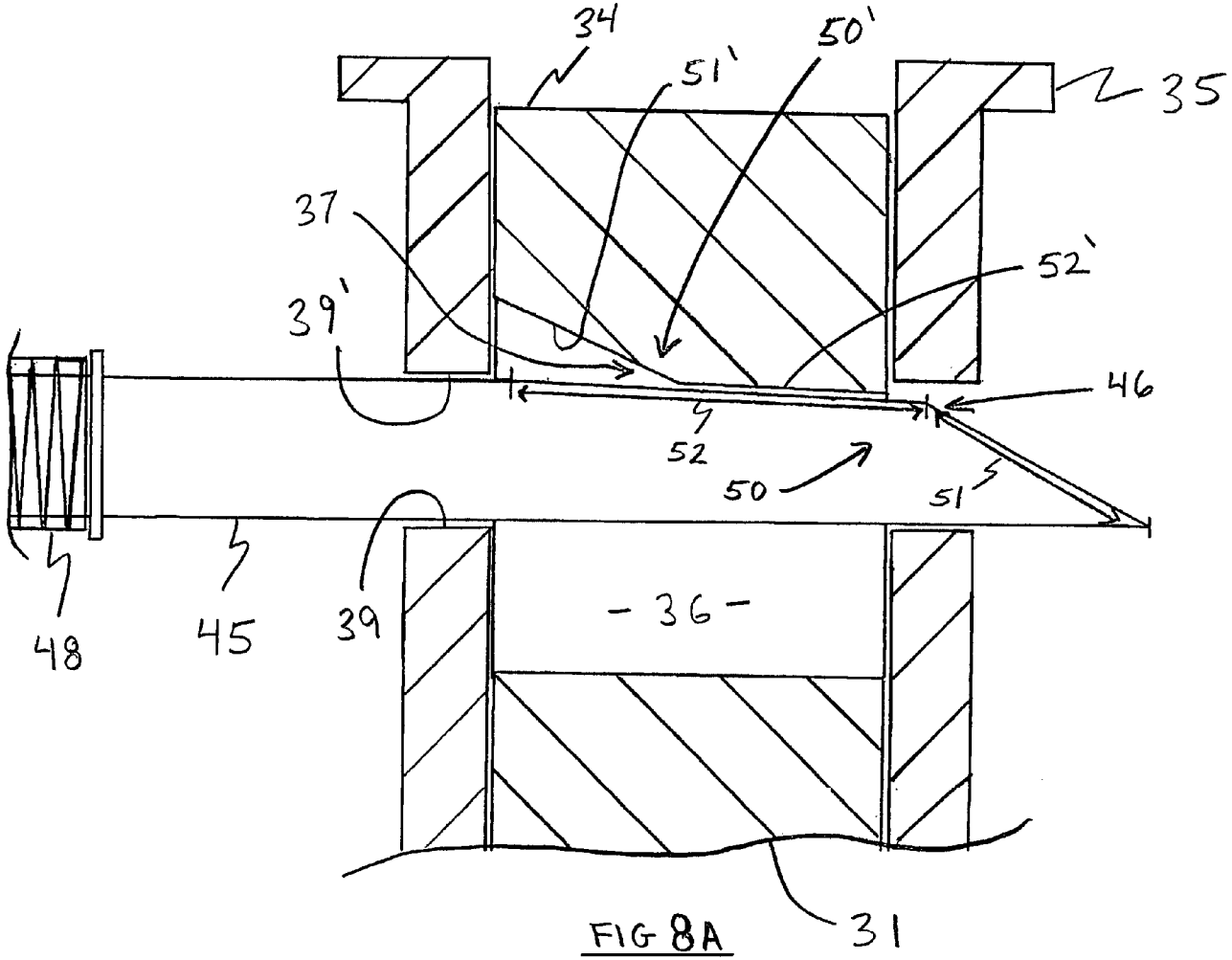
FIG. 8A is a partial cross-sectional view of an engagement member disposed in an operative engagement with a positioning pin in accordance with one embodiment of the present invention.

In at least one further embodiment, as illustrated best in FIG. 8A, the closing surface 37 comprises a composite slope 50', the composite slope 50' having an initial slope 51' of approximately thirty degrees followed by a secondary slope 52' of about two degrees, relative to the substantially planar free end 34 of positioning pin 31. Similarly, and as also illustrated in FIG. 8A, a corresponding and cooperatively structured closing element 46 of engagement member 45 comprises a composite slope 50 having an initial slope 51 of about thirty degrees and a secondary slope 52 of approximately two degrees. The purpose of the composite slope configurations 50, 50' are such that upon initial entry of the closing element 46 into the positioning channel 36, the initial slope 51 of closing element 46 will engage the initial slope 51' of the closing surface 37, thereby causing movement of the fixed blade portion 21 and the movable blade portion 23 into an interlocked orientation with one another. Further, once the closing element 46 of the engagement member 45 has substantially passed through positioning channel 36, as is shown in FIG. 8A, the secondary slope 51 of the closing element 46 operatively engages the secondary slope 51' of closing surface 37 to exert sufficient frictional forces on one another to restrict movement of the engagement member 45 from the positioning channel 36 without a significant and purposeful effort upon a release mechanism, such as release 41 discussed below. The frictional forces generated between the closing elements 46 and closing surface 37, as a result of the interaction between corresponding secondary slopes 52, 52', respectively, also serves to maintain a tight tolerance between handle members 14, 16 and the blade assembly 20, while the blade assembly is disposed in an open configuration. Further, the secondary slopes 52, 52' serve to provide wear surfaces between the closing element 47 and closing surface 37, thereby assuring an extended useful life of the folding knife assembly 10 in accordance with the present invention.

Figure 8B:
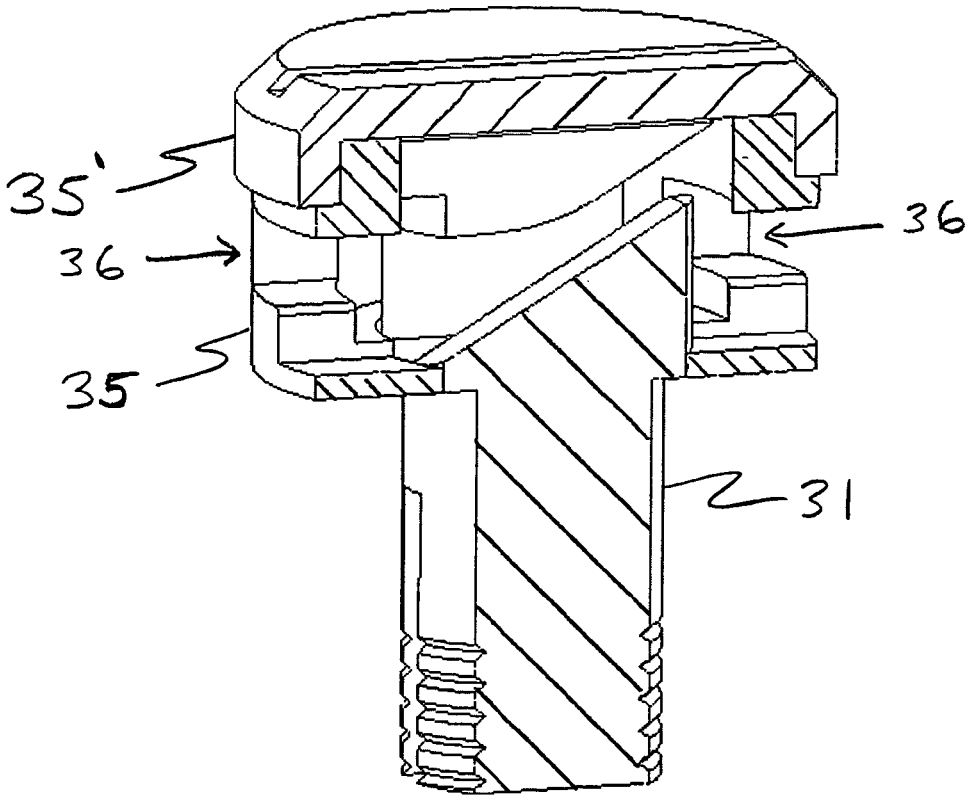
FIG. 8B is a partial cross sectional view of a positing pin and collar in accordance with one embodiment of the present invention.

FIG. 8A also illustrates closing supports 39 and opening supports 39' of collar 35. In operation, when engagement member 45 passes into or out of positioning channel 36, a portion of the engagement member 45 contacts either closing supports 39 or opening supports 39', respectively. The closing supports 39 and opening supports 39' provide a leverage surface for the engagement member 45 to cause movement of the free end 34 of the positioning pin 31 within collar member 35 via its operative engagement of closing surface 37 or opening surface 38, respectively. FIG. 8B is a partial cross section of collar 35 and collar retainer 35' disposed in an operative orientation relative to a positioning pin 31.

Furthermore, FIG. 10 illustrates an opening surface 38 disposed in a spaced apart and opposing relationship to the closing surface 37 in the positioning channel 36 of positioning pin 31. As shown in FIG. 10, opening surface 38 is structured and disposed to slope upwardly form the mouth of positioning channel 36 towards the interior thereof, in an approximately parallel arrangement with the closing surface 37. As noted above with regard to opening surface 38, closing surface 37 is cooperatively structured to be operatively engaged by an opening element 47 of an engagement member 45, once again, as is described in greater detail below with reference FIGS. 17A through 17C. Opening surface 38 may comprise a slope being configured to operatively engage a slope of a cooperatively structured opening element 47 of an engagement member 45. In at least one embodiment, the slope of the opening surface 38 and corresponding opening element 47 are each approximately thirty degrees.

It is noted that FIGS. 8 through 10 are illustrative of only one embodiment and configuration of a positioning channel 36 and corresponding closing and opening surfaces 37 and 38, respectively. As one example, FIG. 5 illustrates positioning pin 31' having a substantially rectangular shaped free end 34 and a correspondingly rectangular shaped positioning channel 36' extending therethrough. As yet another example, positioning pin 31" as illustrated in FIG. 20 comprises positioning channel 36" having a substantially curvilinear configuration which is cooperatively structured for engagement by the "quick release" type lock mechanism 44', as will be described in greater detail below. Of course, it is well within the scope and intent of the present invention for a positioning channel 36 and/or closing surface 37 and/or opening surface 38 to comprise any of a plurality of alternatively or additional geometric configurations which are cooperatively structured to be operatively engaged by an engagement member 45, 45' of a lock mechanism 44, 44'.

Figure 11:
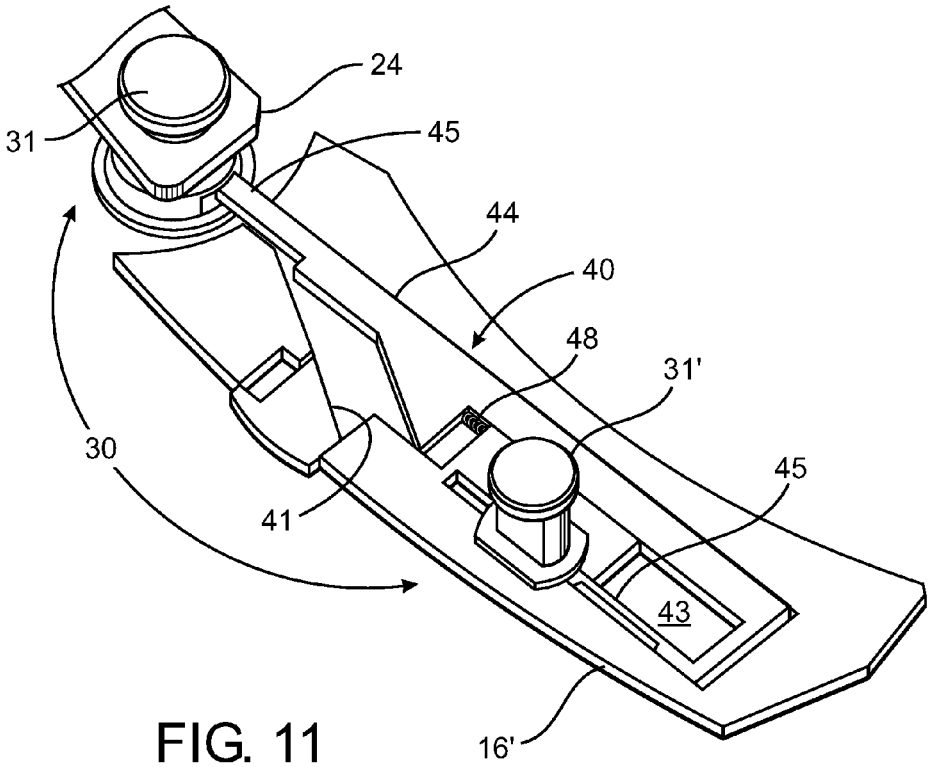
FIG. 11 is partial cutaway perspective view of one embodiment of a locking assembly disposed in an unlocked orientation relative to a positioning assembly, in accordance with the present invention.
Figure 12:
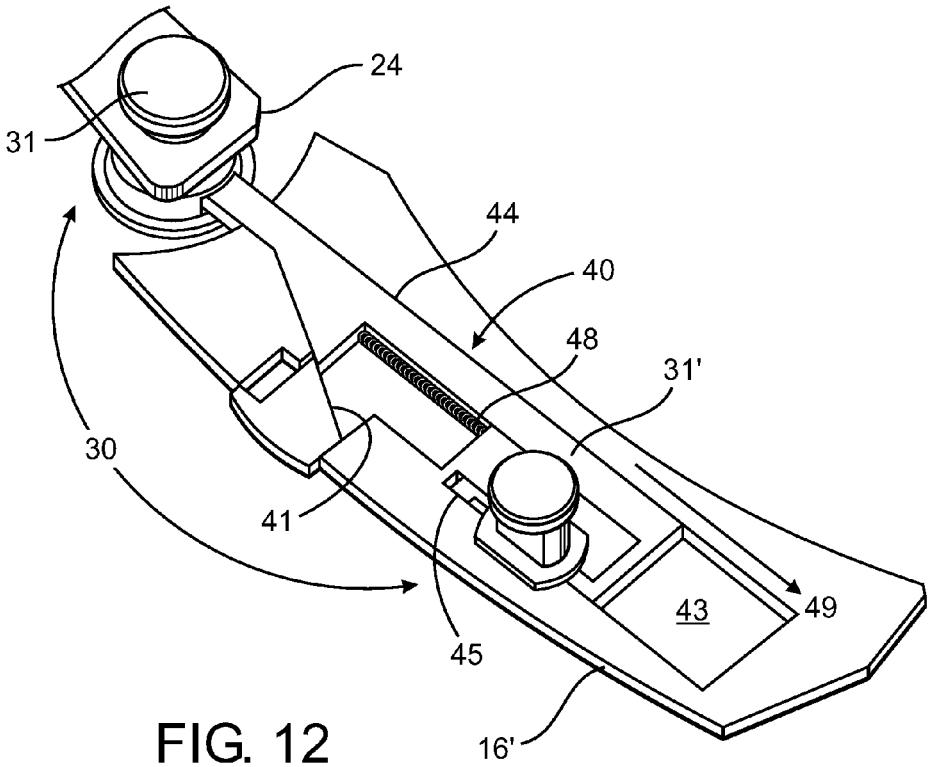
FIG. 12 is partial cutaway perspective view of the embodiment of the locking assembly of FIG. 11 disposed in a locked orientation relative to the positioning assembly.

As indicated above, the folded knife assembly 10 in accordance with the present invention comprises a locking assembly generally as shown at 40 or 40' throughout the Figures. FIGS. 11 and 12, are illustrative of one embodiment of a locking assembly 40 in accordance with the present invention. More in particular, FIGS. 11 and 12 present a partial cutaway perspective view of a lock mechanism 44 disposed in a lock mechanism chamber 43 which is formed in cover member 16' of positionable handle member 16. It will be understood and appreciated from the figures that when cover member 16' is attached to positionable cover member 16, the lock mechanism 44 will be moveably secured and operable in the lock mechanism chamber 43.

FIG. 11 illustrates the locking assembly 40 in an unlocked orientation relative to positioning assembly 30. As shown in FIG. 11, the locking assembly 40 comprises a lock mechanism 44 having a plurality of engagement members 45 which are offset from one another and are structured and disposed to engage a different one of positioning pins 31, 31' of positioning assembly 30. In at least one embodiment, lock assembly 40 includes a biasing member 48 which is structured to reposition the lock mechanism 44 between unlocked and locked orientations relative to the positioning assembly 30. As illustrated in FIG. 11, a biasing member 48 is disposed in a compressed state between the cover member 16' and the lock mechanism 44. Further, FIG. 11 is illustrative of the lock mechanism 44 disposed in an unlocked orientation and as it is positioned just prior to movement into a locked orientation with positioning assembly 30, as is demonstrated by the end of each of engagement member 45 being disposed adjacent to and abutting a corresponding positioning pin 31 and 31'. In the illustrative embodiment of the folding knife assembly as shown in FIGS. 1 through 17, lock mechanism 44 is structured to be retained in the unlocked orientation as illustrated in FIGS. 11 and 13, while movable blade portion 23 is disposed in an at least partially overlying arrangement with fixed blade portion 21.

However, upon positioning of the movable blade portion 23 such that the moveable interlock 24 moves into alignment with fixed interlock 22, such as by rotating the moveable blade portion 23 from the closed configuration of FIGS. 2 and 4, to the open configurations of FIGS. 1 and 3, engagement members 45 of lock assembly 44 are forced through corresponding positioning channels 36 of positioning pins 31 and 33' into the locked orientation, as illustrated in FIG. 12, via the force of biasing member 48. Furthermore, movement of engagement members 45 of lock mechanism 44 through the corresponding positioning channels 36 of positioning pins 31, 31' causes fixed handle member 14 and positionble handle member 16 to move towards one another thereby forcing movable interlock 24 of movable blade portion 23 into an interlocked orientation with fixed interlock 22 of fixed blade portion 21, thus securing the blade assembly 20 in an open configuration. FIGS. 16A through 16C, described below, are illustrative of the interaction of an engagement member 45 of lock mechanism 44 with positioning channel 36 of positioning pin 31 so as to cause movement of fixed handle member 14 and positioning handle member 16 towards one another, and disposition of movable blade portion 23 into an interlocked orientation with fixed blade portion 21.

Looking once again to FIG. 12, biasing member 48 is disposed in an uncompressed state between the portion of cover member 16' and lock mechanism 44. Further, at least a portion of a release 41 is disposed in engagement with a portion of lock mechanism 44. More in particular, in the embodiment of FIG. 12, release 41 comprises a sloped surface which is cooperatively structured to engage a sloped surface of lock mechanism 44 such that the force of pressing downwardly and inwardly on release 41 is sufficient to force lock mechanism 44 to slide rearward, as indicated by directional arrow 49, thereby retracting engagement members 45 from corresponding positioning pins 31 and 31' and returning the locking assembly 40 to the unlocked configuration as shown in FIG. 11. A biasing element 42 may be utilized to return release 41 to an outwardly extended position once the locking assembly 40 has been retuned to the unlocked configuration. More in particular, while in the unlocked configuration of FIG. 11, movable blade portion 23 may be rotated about positioning pin 31 and back into an overlying arrangement with fixed blade portion 21, thereby disposing blade assembly 20 into the closed configuration such as is illustrated best in FIG. 2. FIGS. 17A through 17C as described below are illustrative of the interaction between engagement member 45 of lock mechanism 44 and positioning channel 36 of positioning pin 31 so as to reposition the locking assembly 40 from a locked orientation, as illustrated in FIG. 12, into the unlocked orientation, as illustrated in FIG. 11.

Figure 13:
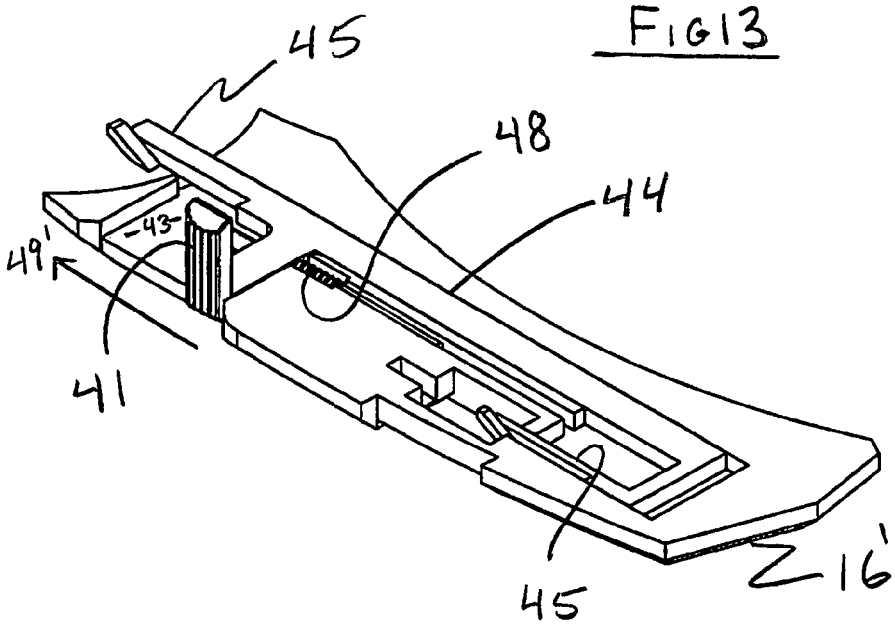
FIG. 13 is partial cutaway perspective view of one alternate embodiment of a locking assembly disposed in an unlocked orientation, in accordance with the present invention.
Figure 14:
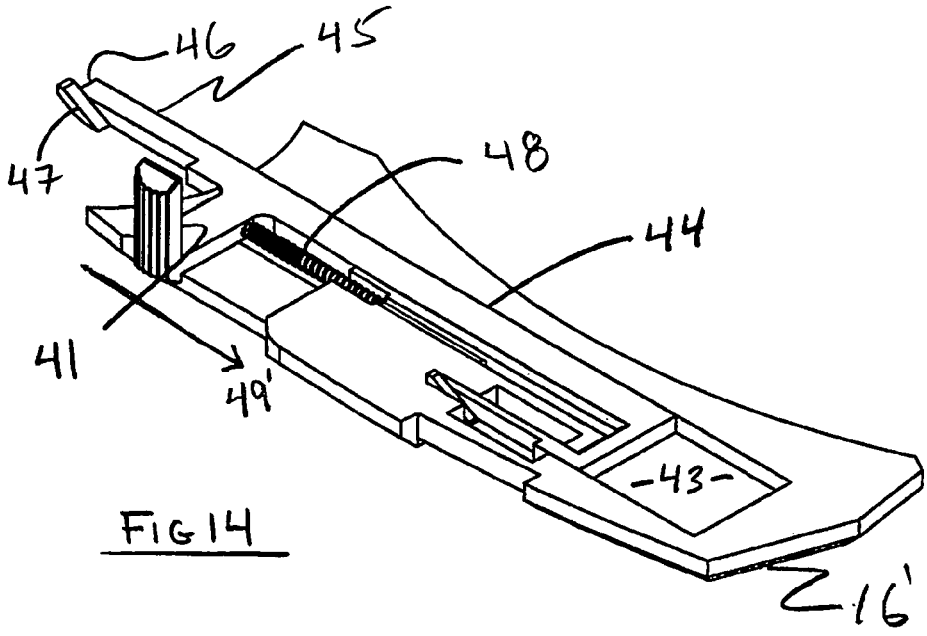
FIG. 14 is partial cutaway perspective view of the embodiment of the locking assembly of FIG. 13 disposed in a locked orientation.
Figure 15:
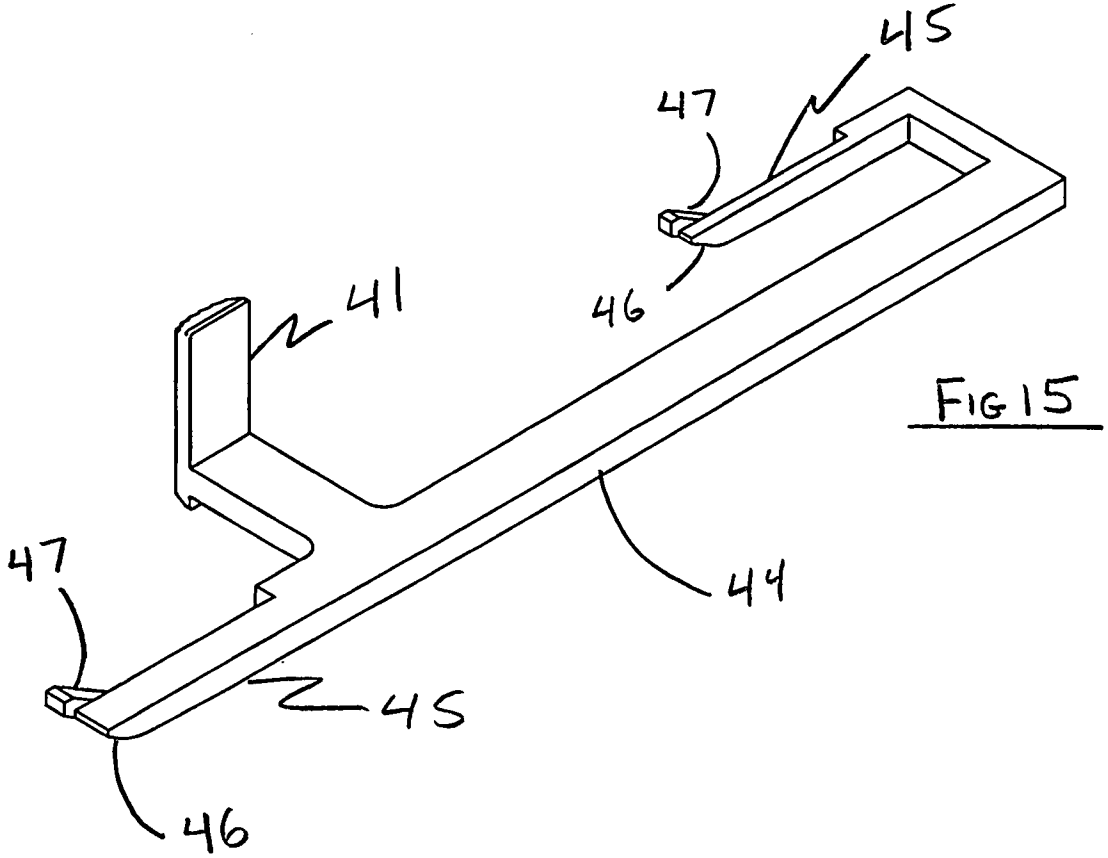
FIG. 15 is perspective view of a lock mechanism in accordance with the alternate embodiment of locking assembly illustrated in FIG. 13.

FIGS. 13 through 15 are illustrative of one alternate embodiment of a lock mechanism 44 in accordance with the present invention. More in particular, lock mechanism 44 of the illustrative embodiment of FIGS. 13 through 15 includes a release 41 being fixedly attached to lock mechanism 44. As such, engagement members 45 of lock mechanism 44 may be moved into and out of engagement with corresponding positioning pins 31 and 31' by directly moving release 41 forward or backward, indicated by directional arrows 49', against the force of biasing member 48. As shown in FIG. 15, the alternate embodiment of lock mechanism 44 comprises a unitary construction comprising release 41. FIG. 15 is further illustrative of closing elements 46 and opening elements 47 of corresponding engagement members 45 which, as previously noted are cooperatively structured to operatively engage corresponding closing surface 37 and opening surface 38 in positioning channel 36 of positioning pin 31, 31'.

Figure 16B:
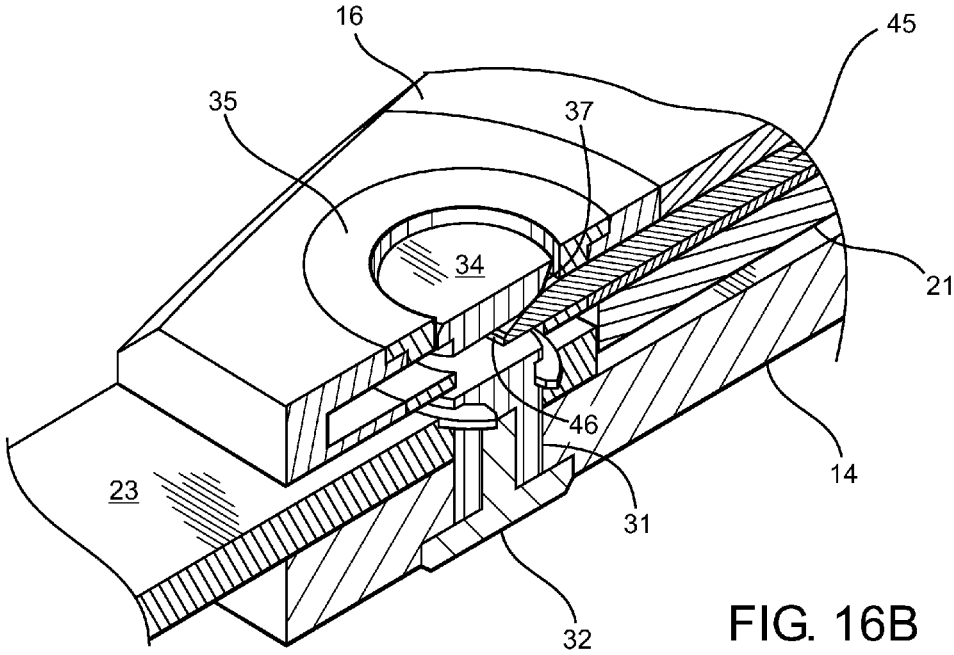
Figure 16C:
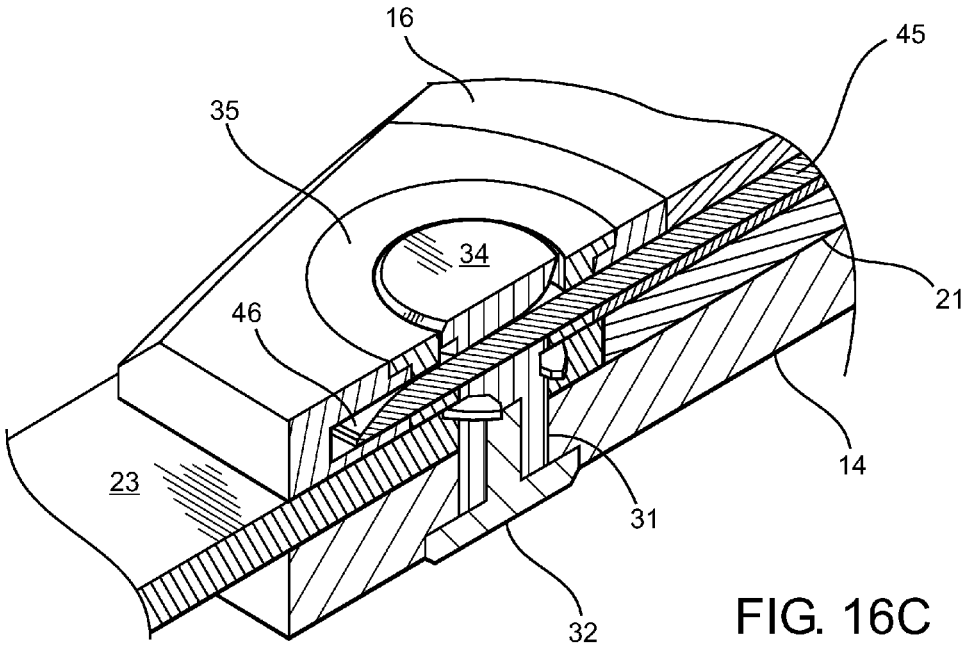

FIGS. 16A through 16C are illustrative of one embodiment of a folding knife assembly 10 in accordance with the present invention wherein an engagement member 45 of a lock assembly 44 engages a positioning pin 31 of a positioning assembly 30 causing fixed handle member 14 and positionable handle member 16 to move towards one another and thereby releasably securing fixed blade portion 21 and movable blade portion 23 of blade assembly 20 in an open configuration. As shown in FIG. 16A, fixed blade portion 21 is affixed to positionable handle member 16 and movable blade portion 23 is moveable secured to fixed handle member 14 via blade retainer 33'. FIG. 16A further illustrates that, at least initially, fixed blade portion 21 is off-set from movable blade portion 23 by a distance slightly greater than the thickness of movable blade portion 23. Closing element 46 of engagement member 45 is disposed adjacent closing surface 37 of positioning pin 31, as also shown in FIG. 16A, and the free end 34 of positioning pin 31 is recessed in and substantially surrounded by collar 35. Collar 35 is fixedly attached to a part of positionable handle member 16, and in at least one embodiment, a collar retainer 35' may be utilized to facilitate fixedly attaching collar 35 to positionable handle member 16. In at least one embodiment, the collar retainer 35' further serves as a cover to prevent dust, dirt, or debris from entering the interior of the folding knife assembly 10. Also illustrated is blade retainer 33' which serves to movably secure movable blade portion 23 about positioning pin 31, and fixed end 32 of positioning pin 31 is fixedly attached to a part of fixed handle member 14.

Looking next to FIG. 16B, engagement member 45 is approximately midway through positioning channel 36, and the interaction of closing element 46 pushing upwardly against closing surface 37 of positioning pin 31 causes positionable handle member 16 to move downward towards fixed handle member 14. This occurs as a result of lock mechanism 44 being movably secured within lock mechanism chamber 43 in positionable handle member 16, and fixed end 32 of positioning pin 31 being fixedly secured to a part of fixed handle member 14. More in particular, as the closing surface 46 of engagement member 45 passes through positioning channel 36, lock mechanism 44, and subsequently, positionable handle member 16, are pulled in a downward direction as shown in FIGS. 16B and 16C. This is best illustrated in FIG. 16B wherein collar 35, which is fixedly attached to positionable handle member 16, is displaced from its original position shown in FIG. 16A, to be substantially flush with the top of free end 34 of positioning pin 31. Also, FIG. 16B illustrates the fixed blade portion 21 abutting at least a part of movable blade portion 23 at their interface.

FIG. 16C is illustrative of engagement member 45 of lock mechanism 44 disposed in a fully locked orientation relative to positioning pin 31. As shown in FIG. 16C, closing element 46 has passed completely through positioning channel 36 of positioning pin 31, collar 35 is fully retracted around free end 34 of positioning pin 31, and, movable blade portion 23 is disposed in a substantially parallel arrangement with fixed blade portion 21, as is clearly demonstrated at the interface of blade portions 21, 23. FIG. 16C is also illustrative of the lock mechanism 44 securely yet releasably retaining moveable blade portion 23 of blade assembly 20 in an open configuration, and that movable blade portion 23 will remain in said open configuration until engagement member 45 is fully retracted through and out of positioning channel 36, thereby allowing positionable handle member 16 to move apart from fixed handle member 14. In doing so, fixed blade portion 21 moves apart from movable blade portion 23, thereby allowing movable blade portion 23 to be rotated about positioning pin 31 into a closed configuration, such as illustrated in FIG. 2.

Release of lock mechanism 44 from a locked orientation to an unlocked orientation relative to positioning pin 31 is illustrated in FIGS. 17A through 17C. Looking first to FIG. 17A, engagement member 45 is disposed substantially through positioning channel 36 of positioning pin 31 in a fully locked orientation. As illustrated in FIG. 17A, opening element 47 of engagement member 45 is configured and cooperatively structured to engage opening surface 38 of positioning pin 31, such as is illustrated best in FIG. 17B. FIG. 17B, also illustrates blade retainer 33' securely yet movably retaining movable blade portion 23 in position adjacent fixed handle member 14 while fixed blade portion 21 moves upwardly with positionable handle member 16. FIG. 17B also illustrates collar 35 moving upwardly around free end 34 of positioning pin 31. Finally, looking to FIG. 17C, engagement member 45 is fully retracted from positioning channel 36 and movable blade portion 23 is offset from fixed blade portion 21 a sufficient distance such that movable blade portion 23 may be rotated about pivot pin 31, thereby disposing blade assembly 20 into a closed configuration, such as illustrated in FIG. 2.

Turning next to FIGS. 18 through 20, an alternate embodiment of a folding knife assembly 10 in accordance with the present invention is illustrated therein. More in particular, FIGS. 18 through 20 are illustrative of an alternate embodiment of a folding knife assembly 10 having a "quick-release" type locking assembly as shown at 40'. FIG. 18 is a perspective view of the folding knife assembly 10 disposed in an open configuration. FIG. 19 is a perspective view of the folding knife assembly 10 having the blade assembly 20 in a closed configuration, wherein the cutting edge 26 of movable blade 23 is disposed in a retention channel 14" which is formed in unitary fixed handle member 14'.

Looking next to FIG. 20, "quick-release" locking assembly 40' includes a lock mechanism 44' comprised of a single component. More in particular, lock mechanism 44' includes engagement members 45' which are structured to engage corresponding positioning channel 36" of positioning pin 31". FIG. 20 further illustrates that lock mechanism 44' includes a plurality of locking elements 46' on either side, as well as a release surface 47'. As shown best in FIGS. 18 and 19, when disposed in a locked orientation, locking elements 46' of lock mechanism 44' are structured to engage a part of movable blade portion 23 and retain movable blade portion 23 in position relative to fixed blade portion 21 in either a substantially parallel arrangement, such as in the open configuration of blade assembly 20 illustrated in FIG. 18, or in a substantially overlying arrangement, such as in the closed configuration of the blade assembly 20 illustrated in FIG. 19. In order to release movable blade portion 23 to allow movement between open and closed configurations, lock mechanism 44' comprises a release 41' which may be rotated in a direction shown by directional arrow 49" to a substantially perpendicular position relative to the movable blade portion 23, thereby allowing movable blade portion 23 to pivot about positioning pin 31" into and out of the open configuration illustrated in FIG. 18. The locking elements 46' of lock mechanism 44' in combination with the curvelinear configuration of positioning channel 36" of positioning pin 31" provide for the application of sufficient force to retain movable blade portion 23 in either the open configuration of FIG. 18 or the closed configuration of FIG. 19. Furthermore, release surface 47' is structured to release said force and provide sufficient clearance between moveable blade portion 23 and fixed blade portion 21 when lock mechanism is rotated such that release surface 47' is disposed in a substantially parallel configuration with the part of movable blade portion 23 and engagement members 45' are repositioned in curvilinear positioning channel 36", thereby allowing movement of movable blade portion 23 into and out of the open and closed configurations.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A folding knife assembly comprising:

a blade assembly having a fixed blade portion and a movable blade portion, wherein said fixed blade portion comprises a fixed interlock and said movable blade portion comprises a movable interlock, said moveable interlock comprises a pivot aperture disposed therethrough, said blade assembly disposable between an open configuration and a closed configuration, wherein said fixed blade portion and said moveable blade portion are structured to cooperatively engage one another while said blade assembly is disposed in said open configuration, said fixed blade portion and said movable blade portion are disposed in a substantially planar arrangement relative to one another while said blade assembly is disposed in said open configuration, said movable interlock is structured and disposed to releasably engage said fixed interlock in an interlocked orientation while said blade assembly is disposed in said open configuration, said fixed blade portion and said movable blade portion are disposed in a substantially overlying arrangement relative to one another while said blade assembly is disposed in said closed configuration, a positioning assembly structured to facilitate disposition of said blade assembly between said open configuration and said closed configuration, said positioning assembly comprising a positioning pin, said pivot aperture of said movable interlock structured to engage said positioning pin such that said movable blade portion is movable relative to said positioning pin, and a locking assembly structured to operatively engage said positioning assembly and releasably secure said blade assembly in said open configuration.

2. The assembly as recited in claim 1 wherein said positioning pin comprises a blade retaining mechanism, said blade retaining mechanism structured to moveably secure said movable blade portion to at least a portion of said positioning pin.

3. The assembly as recited in claim 1 wherein said positioning pin comprises a positioning channel.

4. The assembly as recited in claim 3 wherein said locking assembly is structured to engage said positioning channel to releasably secure said movable blade portion into said substantially planar arrangement with said fixed blade portion.

5. The assembly as recited in claim 4 wherein said locking assembly is further structured to disengage from said positioning channel to permit movement of said movable blade portion into said substantially overlying arrangement with said fixed blade portion.

* * * * *